US006560940B2

(12) United States Patent
Mueller

(10) Patent No.: US 6,560,940 B2
(45) Date of Patent: May 13, 2003

(54) TWO-PIECE CLINCHED PLATE TENSION/COMPRESSION BRACKET

(76) Inventor: Lee W. Mueller, 4132 S. Rainbow Blvd., PBM #247, Las Vegas, NV (US) 89103

( * ) Notice: Subject to any disclaimer, the term of this patent is extended or adjusted under 35 U.S.C. 154(b) by 0 days.

(21) Appl. No.: 09/932,530

(22) Filed: Aug. 17, 2001

(65) Prior Publication Data

US 2002/0020136 A1 Feb. 21, 2002

Related U.S. Application Data

(60) Provisional application No. 60/226,359, filed on Aug. 18, 2000.

(51) Int. Cl.[7] ..... E02D 27/00

(52) U.S. Cl. ..... 52/295; 52/167.4; 52/293.1; 52/715; 411/536

(58) Field of Search ..... 52/167.1, 167.4, 52/167.8, 272, 274, 293.1, 295, 712, 713, 715; 411/536, 916, 917

(56) References Cited

U.S. PATENT DOCUMENTS

| | | | | |
|---|---|---|---|---|
| 140,526 | A | | 7/1873 | Munson, Jr. |
| 2,780,936 | A | | 2/1957 | Hillberg |
| 3,037,593 | A | | 6/1962 | Webster |
| 3,328,927 | A | | 7/1967 | Kates |
| 3,822,521 | A | | 7/1974 | Lucas |
| 3,871,153 | A | | 3/1975 | Birum, Jr. |
| 3,894,370 | A | | 7/1975 | Parazader |
| 4,078,350 | A | | 3/1978 | Ting |
| 4,603,531 | A | | 8/1986 | Nash |
| 4,631,894 | A | | 12/1986 | Jerila |
| 4,641,726 | A | | 2/1987 | Fearon et al. |
| 4,675,238 | A | | 6/1987 | Karoubas |
| 4,905,444 | A | | 3/1990 | Semaan et al. |
| 5,054,251 | A | | 10/1991 | Kemeny |
| 5,303,520 | A | | 4/1994 | Gozdziak |
| 5,364,214 | A | * | 11/1994 | Fazekas ..... 411/536 |

(List continued on next page.)

OTHER PUBLICATIONS

Fahim Sadek, Bijan Mohraz, Andrew W. Taylor, and Riley M. Chung, "Passive Energy Dissipation Devices for Seismic Applications", NISTIR 5923, United States Department of Commerce Technology Administration, Nov. 1996.

(List continued on next page.)

*Primary Examiner*—Carl D. Friedman
*Assistant Examiner*—Naoko Slack
(74) *Attorney, Agent, or Firm*—Knobe, Martens, Olson & Bear, LLP.

(57) ABSTRACT

A two-piece bracket adapted to resist forces in both tension and compression. The tension/compression bracket is formed from stamped, plate steel and is preassembled by clinching. The tension/compression bracket provides a range of adjustability of attachment to allow for a limited range of placement of other components that attach to the tension/compression bracket. In one embodiment, the tension/compression bracket includes a resilient resistance to tension forces. The resilient resistance is provided by a high spring constant coil spring. The resilient resistance provides a limited degree of movement under tension. The limited degree of movement is chosen by component selection to be non-damaging.

35 Claims, 6 Drawing Sheets

U.S. PATENT DOCUMENTS

| | | | | |
|---|---|---|---|---|
| 5,375,384 | A | 12/1994 | Wolfson | |
| 5,390,466 | A | 2/1995 | Johnson et al. | |
| 5,619,837 | A | 4/1997 | DiSanto | |
| 5,687,529 | A | 11/1997 | Pickering | |
| 5,706,626 | A | 1/1998 | Mueller | |
| 5,904,025 | A | 5/1999 | Bass et al. | |
| 5,913,788 | A | 6/1999 | Herren | |
| 6,006,487 | A | 12/1999 | Leek | |
| 6,012,256 | A | 1/2000 | Aschheim | |
| 6,058,668 | A | 5/2000 | Herren | |
| 6,390,747 | B1 * | 5/2002 | Commins | 411/536 |

OTHER PUBLICATIONS

PACO The Engineered Steel Company brochure.

Light Beam System, Low Cost Steel Frame Housing, Light Beam Inc., Brochure, Jan. 1997.

Light Beam System, LBN Shear Panel, Ligh Beam, Inc. Brochure, Jan. 1997.

Ultra–Span Prefabricated Light Gauge Steel Truss System, MiTek, Brochure, 1996.

CeeWal brochure Jul. 1999.

Shear Max Panel, brochure, 1998.

Zwall, Strength Where You Need It, brochure.

ICBO Evaluation Service, Inc., Evaluation Report, Strong–Wall Shear Panels, Simpson Strong Tie Company, PFC–5485, Feb. 1, 1999.

Strong–Wall Shearwall, Simpson Strong Tie brochure, 1999.

Strong–Wall Shearwall brochure, Simpson Strong Tie Connectors, Form PF–SW3 3/99 EXP Jun. 2000.

Shear Max™ Panel, Product description brochure, 1998, 1 page.

Shear–Max™ Panel, Installation Instructions, 1 page.

Multi–Direction Insert brochure, Connection Specialties, Inc.

SEMCO Metal Connectors, Southeastern Metals Manufacturing Company, Inc. Catalog, 1998.

* cited by examiner

TWO-PIECE CLINCHED PLATE TENSION/COMPRESSION BRACKET

RELATED APPLICATIONS

This application claims the benefit of U.S. Provisional Application No. 60/226,359 filed Aug. 18, 2000, entitled "TWO-PIECE CLINCHED PLATE TENSION/COMPRESSION BRACKET."

BACKGROUND OF THE INVENTION

1. Field of the Invention

The invention relates to the construction industry and, in particular, concerns a method of interconnecting building members to anchor structures.

2. Description of the Related Art

In typical residential and light industrial/commercial building frame wall construction, load bearing frame walls are comprised of a series of studs and posts that are anchored to the foundation and covered with sheathing material installed over both sides of the frame. Typically, the frame is constructed from a number of vertically extending studs that are positioned between and interconnected with upper and lower plates. The lower plates and/or vertical studs are typically anchored to the foundation in some fashion. The covering material, plywood, sheet rock, siding, plaster, etc. is then attached over the studs.

Natural forces commonly occur that impose vertical and horizontal forces on the structural elements of the buildings. These forces can occur during earth movement in an earthquake and from high wind conditions such as hurricanes, tornadoes, cyclones, or other extreme weather conditions. If these forces exceed the structural capacity of the building, they can cause failures leading to damage to or the collapse of the building with resultant economic loss and potential injuries and loss of life.

A typical method of securing a frame to a foundation is to connect one end of a length of metal strapping to an end of wall stud and to embed the other end in the concrete foundation. Uplift forces acting on the building frame are resisted through the embedded strap. The use of metal strapping is convenient to install, but has strength limitations to inhibit uplift. In particular, the metal strapping is typically attached to a frame member such as a post using relatively few fasteners. Thus, each of the fasteners are subjected to a relatively large fraction of the transferring force, increasing the likelihood of the fastener or its attachment points failing.

Another need in existing construction materials and techniques arises with respect to the vertical loads carried by a building's frame. The gravity weight of a building and its contents direct a vertical load that is typically transferred to and carried by the vertical load bearing studs or posts of the building's frame. These vertical members typically bear at their lower end on a pressure treated mudsill.

A mudsill typically comprises a number of 2×4 pieces of lumber placed directly on a foundation so as to lay on the face defined by the 4" dimension and the longest dimension. A mudsill is also used as a nailing surface along the lower extent of the exterior walls. The inherent structural problem with the mudsill, comprising a wooden member, is that it has less capacity to resist crushing because of the orientation of the grain of the wood. A compressive distortion in the mudsill allows the vertical load-bearing studs to move downwards due to the incident vertical load. Compressive movement of the vertical end studs in a shear panel creates deflection in the walls of the building, weakening the overall structure, providing impetus for cracks to form in the external and interior wall finishings, and potentially concentrating load stresses in unforeseen and damaging ways.

Furthermore, devices that fasten vertical members such as posts to the foundation do so in a substantially rigid manner. In certain force situations, having a substantially rigid and strong interconnection of the post to the foundation may lead to failures at another location.

From the foregoing, it can be appreciated that there is a continuing need for a method and device to continuously secure and anchor a building frame to a foundation. The desired anchoring method should be convenient to install, yet offer strength advantages to the existing use of metal strapping. It would be an additional advantage for the device to be capable of supporting vertical compression loads as well as tension loads to thereby enable the device to transfer loads directly to the foundation. There is a need for a attachment apparatus that permits use of ductile elements so as to allow the attachment apparatus to dissipate a portion of the tension or compression loads, while transferring the rest to the foundation.

SUMMARY OF THE INVENTION

The aforementioned needs are satisfied by the device for transferring tension and compression forces incident on a vertical support of a building of the present invention. In one aspect, the device comprises an attachment member having at least one planar surface that is sized to be attached to the vertical support of the building, the attachment member includes a laterally extending section that extends outward from the planar surface. The device further comprises, in this aspect, a load piece that is attached to the attachment member. The load piece includes a mounting section that defines a recess and the load piece receives the laterally extending section in the mounting section such that the laterally extending section reinforces the mounting section. In this aspect, the load piece has upper and lower surfaces that define opening through which the anchor bolt can be extended and coupled thereby securing device to the foundation. The use of two separate pieces, one of which is attached to the building support and the other being attached to the foundation results in a more rigid structure better able to transfer forces without deformation.

In one implementation, the device includes a laterally extending piece that extends underneath the vertically extending member such that the vertically extending member is spaced from the foundation. This permits the use of non-pressure treated wood to be used in the vertical extending member thereby permitting costs savings in construction.

In another implementation, the device includes a spring member that is attached to the anchor bolt such that uplift forces that are transferred from the vertical building support are at least partially absorbed by the spring structure. In one embodiment, the spring structure is mounted so as to be mechanically coupled to the mounting section of the mounting member such that uplift forces result in compression of the spring.

In another aspect of the invention, the invention comprises a device for transferring tension and compression forces incident on a vertical support of a building to an anchor bolt extending out of the foundation of the building. The device comprises an attachment member having a planar surface that is attachable to the vertical support of the building wherein the attachment member is shaped so as to define a reinforcing section that extends outward from the planar surface. The device further comprises a mounting member that is attached to the attachment member, wherein the mounting member includes a planar surface that is shaped so as to define a mounting section that defines a recess which receives the reinforcing section of the attachment member. The mounting member further includes openings so as to permit the anchor bolt to extend therethrough such that when the anchor bolt is mechanically coupled to the mounting section and the planar surface of the attachment member is attached to the vertical support tension and compression forces incident on the vertical support of the building can be transmitted to the anchor bolt.

In this aspect, the attachment member and the mounting member are formed of shaped pieces of metal wherein a generally planar piece of metal is bent and cut to form the desired shapes. In this way, significant manufacturing costs savings can be achieved.

Hence, the device of the present invention provides a more effective, low cost hold down structure. These and other objects and advantages will be more apparent from the following description taken in conjunction with the accompanying drawings.

DETAILED DESCRIPTION OF THE PREFERRED EMBODIMENT

Figure 1:
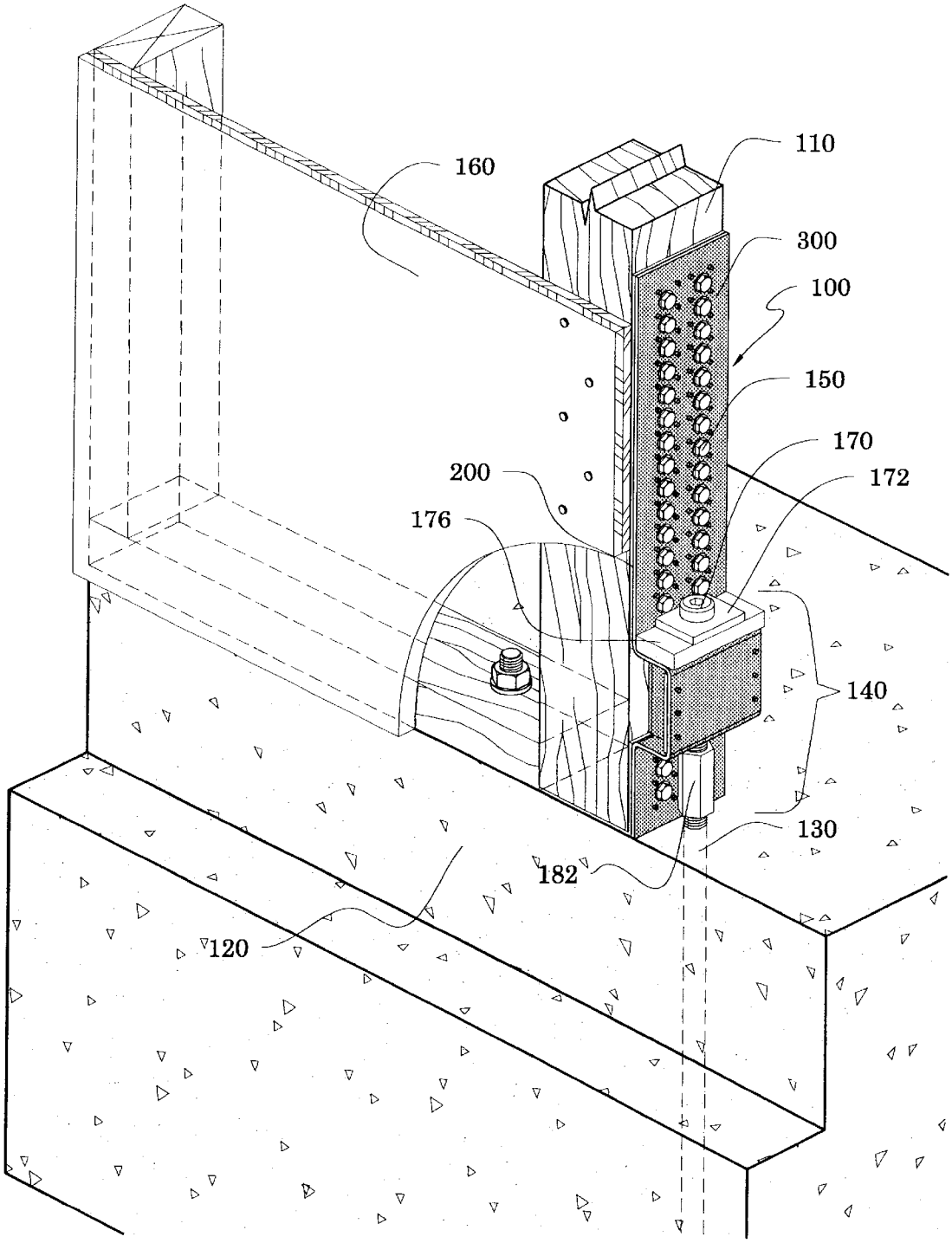
FIG. 1 illustrates a perspective view of a two-piece clinched plate tension/compression bracket interconnecting a post to a foundation so as to transfer tension and compression forces on the post to the foundation.

Reference will now be made to the drawings wherein like numerals refer to like parts throughout. FIG. 1 illustrates one embodiment of a two piece clinched plate tension/compression bracket 100 (referred to as bracket hereinafter) interconnecting an elongate structure member such as a post 110 to a foundation 120. The bracket 100 is attached to the post by a plurality of fasteners such as screws 150 or bolts in a substantially rigid manner. The bracket is further attached to an anchor member such as an anchor bolt 130 by an connecting assembly 140. As will become evident with description of individual parts below, the bracket 100 is adapted to transfer tension and compression forces on the post 110 to the foundation 120. In one embodiment, the bracket 100 is sized to allow finishing materials such a wall panels 160 to be installed.

Figure 2A:
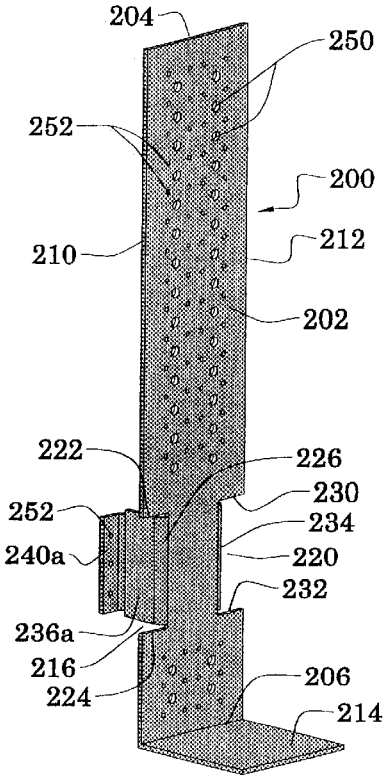
FIG. 2A is a perspective view illustrating an inner plate of the bracket of FIG. 1.
Figure 2B:
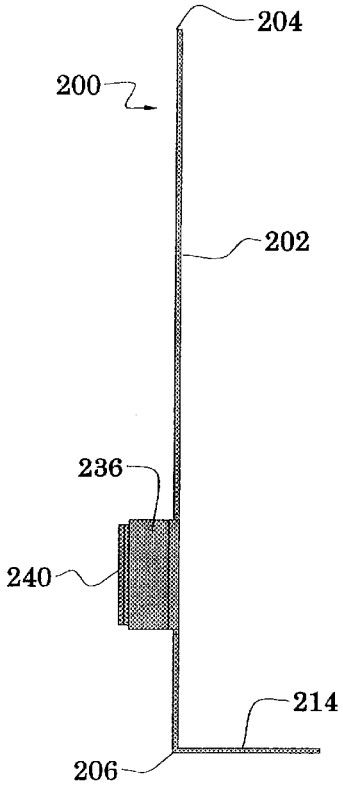
FIG. 2B is a side view of the inner plate of FIG. 2A.

As shown in FIG. 1, the bracket 100 comprises an inner plate 200 interposed between the post 110 and an outer plate 300. The inner plate 200 is illustrated in FIGS. 2A to 2D. As shown in FIGS. 2A and 2B, the inner plate 200 comprises a rectangular shaped upper section 202 that extends lengthwise in a first direction from a first end 204 to a second end 206. The upper section 202 further comprises a first side 210 and a second side 212, such that the first and second sides 210 and 212 are substantially parallel and first and second ends 204 and 206 are substantially parallel. Attached to the second end 206 is a rectangular shaped base section 214 that extends in a second direction that is substantially perpendicular to the first direction. The base section 214 is oriented such that its attachment edge coincides with the edge on the second end 206. In the preferred embodiment, the inner plate 200 is made of a single contiguous member that is bent into the shape shown in FIGS. 2A–2D. Thus, a plane defined by the upper section 202 is substantially perpendicular to a plane defined by the base section 214. The upper section 202 engages one of the sides of the post 110 in a manner described below. The base section 214 engages the bottom of the post 110 in a manner described below so as to be interposed between the post 110 and the foundation 120.

The upper section 202 of the inner plate 200 defines a first recess 216 and a second recess 220. The first recess 216 is located along the first side 210, approximately ¾ of the way from the first end 204 to the second end 206. The first recess 216 is defined by a first edge 222, a second edge 224, and a third edge 226 arranged such that the first and second edges 222 and 224 are substantially parallel to the first and second ends 204 and 206, and the third edge 226 is substantially parallel to the first side 210. The second edge 224 is between the first edge 222 and the second end 206, and the third edge 226 is between the first side 210 and the second side 212.

The second recess 220 is located along the second side 212, and is a substantial mirror image of the first recess about a plane substantially perpendicular to the first section and substantially half way between the first and second sides 210 and 212. Similar to the first recess 216, the second recess 220 is defined by a first edge 230, a second edge 232, and a third edge 234. The second edge 232 is parallel to, and between the first edge 230 and the second end 206. The third edge 234 is parallel to, and between the second side 212 and the first side 210.

Figure 2C:
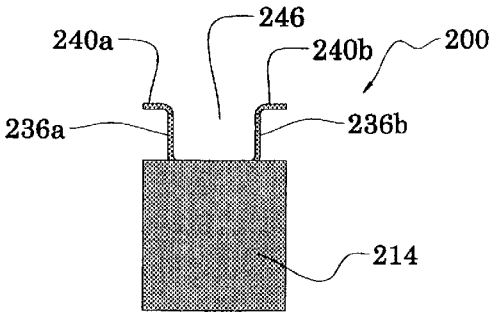
FIG. 2C is a plan view of the inner plate of FIG. 2A.

As seen FIGS. 2A and 2C, extending from the third edge 226 of the first recess 216 is a coupling section 236. The coupling section 236 is a rectangular shaped member that extends in a third direction that is substantially perpendicular to the first direction specified above, and substantially opposite the second direction also specified above. A plane defined by the coupling section 236 is substantially perpendicular to the plane defined by the upper section 202, and also substantially perpendicular to the plane defined by the base section 214.

Extending from the coupling section 236*a* is a flange section 240*a*. The flange section 240*a* is a rectangular shaped member that extends towards the first side 210. A plane defined by the flange section 240*a* is substantially perpendicular to the plane defined by the coupling section 236*a* and substantially parallel to the plane defined by the upper section 202.

In a similar manner, extending from the third edge 234 of the second recess 220 is a coupling section 236*b* and a flange section 240*b*, wherein the coupling and flange sections 236*b*, 240*b* are substantial mirror images of the coupling and flange sections 236*a* and 240*b*, respectively, about the plane substantially perpendicular to the upper section 202 and substantially half way between the first and second sides 210 and 212. Thus the coupling section 236*b* extends in the third direction, and is substantially parallel to the coupling section 236*a*. The flange section 240*b* extends from the coupling section 236*b* towards the second side 212.

The coupling sections 236*a*, 236*b* and the flange sections 240*a*, 240*b* have dimensions along the first direction that are less than the separation distance between the first and second edges 222 and 224 of the first recess 216 by approximate an amount necessary to cut out the coupling sections 236*a*, 236*b* from the first section 202. The flange sections 240*a*, 240*b* sized such that when the inner plate 200 is viewed facing the first section, as in FIG. 2D, the flange sections 240*a*, 240*b* are superimposed substantially within the first recess 216.

The coupling sections 236*a*, 236*b* and the flange section 240*a*, 204*b*, when viewed in cross section along the first direction, extend in two dimensions, so as to resist buckling when subjected to forces along (and opposite) the first direction. The coupling sections 236*a*, 236*b* and flange sections 240*a*, 240*b* are sized to fit inside a portion of the outer plate 300 in a manner described below. In particular, the coupling sections 236*a*, 236*b* and the upper section 202 define an opening 246, as seen in FIG. 2C, through which a bolt extends in the first direction so as to interconnect the bracket 100 to the foundation 120 in a manner described below.

The upper section 202 of the inner plate 200 further defines a plurality of fastener holes 250 that permit the screws 150 (FIG. 1) to extend therethrough so as to engage the post 110. The fastener holes 250 are arranged throughout the upper section 202 in a selected manner so as to distribute the forces being transferred throughout the upper section 202.

Figure 2D:
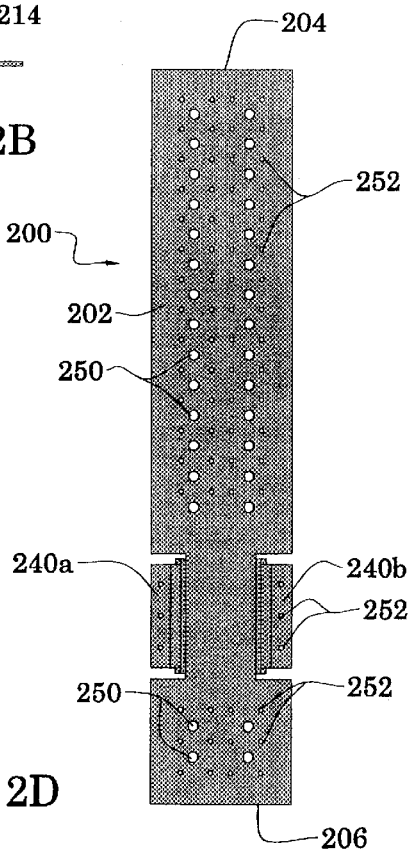
FIG. 2D is a front view of the inner plate of FIG. 2A.

The upper section of the inner plate 200 further defines a plurality of clinch holes 252 that are sized to receive a plurality of clinches on the outer plate 300 described below. As shown in FIGS. 2A and 2D, the flange sections 240*a*, 240*b* also define a plurality of clinch holes 252 that are sized to receive clinches on the outer plate 300. The clinch holes 252 are arranged throughout the upper and flange sections 202, 240*a*, and 240*b* in a selected manner so as to mechanically couple the inner plate 200 to the outer plate 300 in a substantially rigid manner such that transfer of forces is further improved.

In one embodiment, the inner plate 200 is formed from an ⅛" thick steel plate. The upper section 202 has dimensions of approximately 1'–6"×3 ½". The first and second recesses 216 and 220 are approximately ¾" deep (distance between the first, second sides 210, 212 and the respective third edges 226, 234), and approximately 3" high (distance between respective first, second edges 222, 224 and 230, 232). The first edges 222 and 230 of the first and second recesses 216 and 220 are separated from the first end 204 by approximately 1'. Each of the coupling sections 236*a*, 236*b* has dimensions of approximately 1⅜" in the third direction, and approximately 2¾" in the first direction. Each of the flange sections 240*a*, 240*b* has dimensions of approximately ¾" towards first and second sides 210 and 212, and approximately 2½" in the first direction. The base section 214 extends approximately 3⅝" in the second direction, and is approximately 3½" wide. The fastener holes 250 are sized to have a diameter of approximately ¼".

Figure 3A:
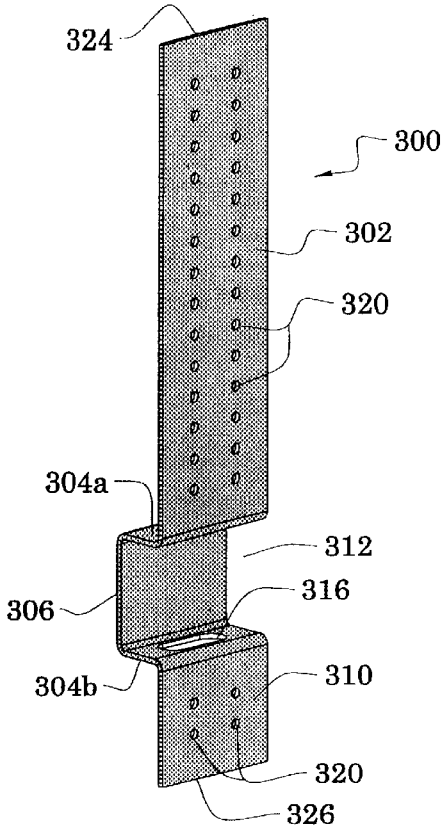
FIG. 3A is a perspective view illustrating an outer plate of the bracket of FIG. 1.
Figure 3B:
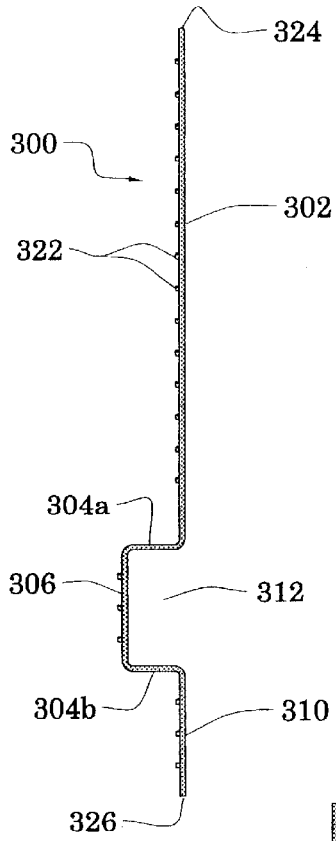
FIG. 3B is a side view of the outer plate of FIG. 3A.

FIGS. 3A to 3D illustrate the outer plate 300 that is positioned adjacent the inner plate 200 as shown in FIG. 1. As shown in FIGS. 3A and 3B, the outer plate 300 comprises a series of rectangular shaped sections connected in series, edges to edges, extending in first, second, and third directions specified above. Specifically, the second and third directions are substantially opposite to each other, and substantially perpendicular to the first direction. The outer plate 300 comprises a first end 324 from which an upper section 302 extends lengthwise in the first direction. A first offset section 304*a* extends in the third direction from the end of the upper section 302. A recessed section 306 extends in the first direction from the end of the second section 304. A second offset section 304*b* extends in the second direction from the third section 306. A lower section 310 extends in the first direction from the second section 304*b*. The end of the lower section 310 defines a second end 326 of the outer plate 300.

The upper section 302 and the lower section 310 are substantially coplanar, and substantially parallel to the recessed section 306. The first and second offset sections 304*a*, 304*b* are substantially parallel with each other, and substantially perpendicular to the first section 302. The second and fourth sections 304 and 308 have substantially similar dimensions.

The offset sections 304*a*, 304*b* and the recessed section 306 define a recess 312 that is located approximately ¾ of the way from the first end 324 to the second end 326. The recess 312 is sized to receive the coupling sections 236*a*, 236*b* and the flange sections 240*a*, 240*b* of the inner plate 200. The upper and lower sections 302 and 310 are sized to be engaged with the upper section 202 of the inner plate 200 in a manner described below.

The upper, lower and recessed sections 302, 306, and 310 comprise a plurality of clinches 322 that are sized and arranged to be secured to the clinch holes 252 defined by the inner plate 200. In particular, the clinches 322 on the upper section 302 of the outer plate 300 are secured to the clinch holes 252 defined by the upper portion of the upper section 202 of the inner plate 200. The clinches 322 on the lower section 310 of the outer plate 300 are secured to the clinch holes 252 defined by the lower portion of the upper section 202 of the inner plate 200. The clinches 322 on the recessed section 306 of the outer plate 300 are secured to the clinch holes 252 defined by the flange sections 240*a* and 240*b* of the inner plate 200. The plurality of clinches described above secure the outer plate 300 to the inner plate 200 in a substantially rigid manner so as to improve the force transferring capacity of the bracket 100. The clinching of the outer plate 300 to the inner plate 200 is preferably performed at a factory.

The upper and lower sections 302 and 310 of the outer plate 300 define a plurality of fastener holes 320 that permit fasteners such as screws 150 (FIG. 1) to extend therethrough. The holes 320 are sized and arranged in a selected manner so as to substantially match the fastener holes 250 defined by the inner plate 200. The holes 320 and the holes 250 permit the screws 150 to pass through so as to secure the bracket 100 to the post 110. It will be appreciated that distribution of the fastener holes 320, 250 and the clinches 322, 252 throughout the bracket 100 permit the forces being transferred by the bracket 100 to be distributed so as to reduce localization of forces that can lead to structural failures.

Figure 3C:
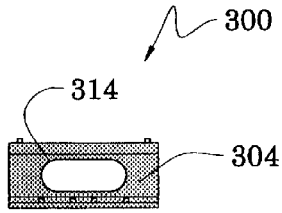
FIG. 3C is a plan view of the outer plate of FIG. 3A.
Figure 3D:
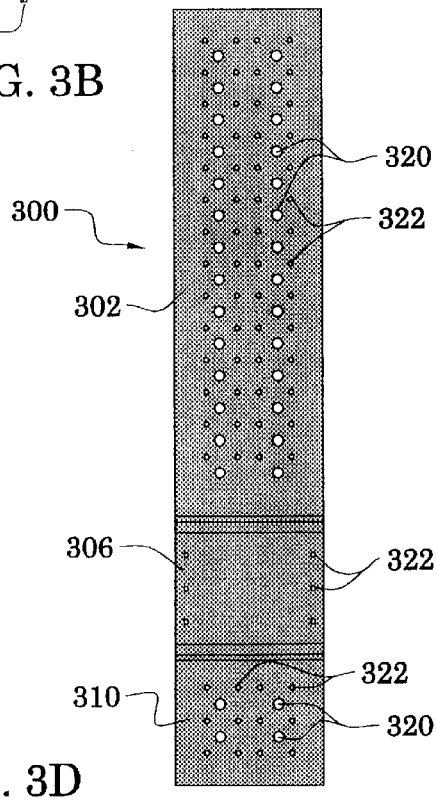
FIG. 3D is a front view of the outer plate of FIG. 3A.

As shown in FIGS. 3A and 3C, the first and second offset sections 304*a*, 304*b* of the outer plate 300 defines a first slot 314 and a second slot 316, respectively. The first and second slots 314 and 316 extend along a fourth direction that is substantially perpendicular to both first and second (and thus third) directions. The slots 314, 316 permit a hold down bolt 170 (FIG. 1) to extend therethrough so as to interconnect the bracket 100 to the foundation 120 in a manner described below. The slots 314, 316 permit limited adjustment in positioning of the bracket 100 to compensate for a possibly misaligned anchor bolt 130.

In one embodiment, the outer plate 300 is formed from an ⅛" thick steel plate. The width of the outer plate 300 along the fourth direction is approximately 3½", thus defining one of the dimensions of the five rectangular sections 302, 304, 306, 308, 310. Thus, the other dimension of the five sections 302, 304, 306, 308, 310 are, respectively, approximately 1', 1½", 3", 1½", 3". The slots 314, 316 are approximately 2" long end to end, and approximately ⅝" wide.

As shown in FIG. 1, when the inner plate 200 is attached to the outer plate 300, the coupling and flange sections 236*a*, 236*b* of the inner plate and the recess 246 defined therebetween are positioned within the recess 312 defined by the outer plate 300. The coupling sections 236*a*, 236*b* and flange sections 240*a*, 240*b* extend in third and fourth directions, respectively, both of which are substantially perpendicular to the first direction so as to resist buckling under forces directed parallel to the first direction. Portions of the recess 246 of the inner plate 200 and the recess 312 of the outer plate 300 overlap to define a space interposed between the slots 314 and 316, so as to permit the hold down bolt 170 to extend through.

Figure 4:
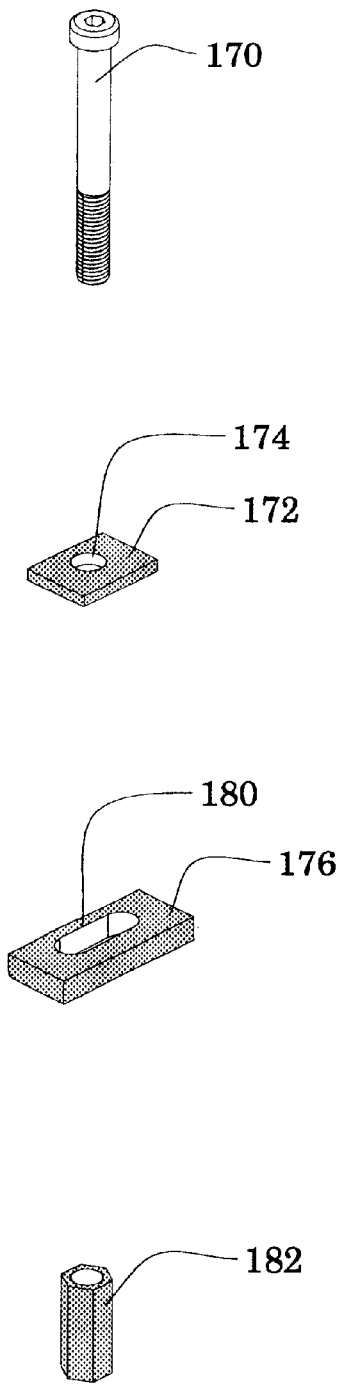
FIG. 4 illustrates a hold down bolt, a washer plate, a slotted bearing plate, and a coupling nut that are used to interconnect the bracket to the foundation.

As shown in FIG. 1, the bracket 100 is interconnected to the foundation by the connecting assembly 140 that comprises the hold down bolt 170, a washer plate 172, a slotted bearing plate 176, and a coupling nut 182. These parts that form the connecting assembly 140 are illustrated in FIG. 4. The washer plate 172 is a rectangular shaped plate that defines a hole 174 through which the hold down bolt 170 passes through. The washer plate 172 distributes the load from the head of the hold down bolt 170 to the slotted bearing plate 176 that is positioned adjacent the washer plate 172 when the.

The slotted bearing plate 176 is a substantially stiff rectangular shaped plate that defines a slot 180 substantially centered that extends lengthwise. The bearing plate 176 is interposed between the washer plate 172 and the second section 304 (FIG. 3B) of the outer plate 300, and is sized similar to the second section. When the post 110 is under tension, the upward force is transferred to the bracket 100, and then to the hold down bolt 170 via the bearing plate 176 and the washer plate 172. The bearing plate 176, being in contact with the second section 304 face to face, distributes the contact force therebetween so as to inhibit deformation of the bracket 100.

The slot 180 defined by the bearing plate 176 extends along the fourth direction specified above so as to provide limited adjustment of the positioning of the bracket relative to the anchor bolt 130. The connecting assembly 140 further comprises a coupling nut 182 that mechanically couples the threaded end of the hold down bolt 170 to the threaded end of the anchor bolt 130 that protrudes from the foundation 120.

In one embodiment, the hold down bolt 170 is a ⅝"×5¼" bolt. The washer plate 172 is an approximately ¼" thick steel plate with dimensions of approximately 2"×1½. The hole 174 is sized to have a diameter of approximately 11/16", and its center is located at the substantial center lengthwise, and approximately ⅝" from one of the long sides so as to be off centered widthwise. The slotted bearing plate 176 is an approximately ½" thick steel plate with dimensions of approximately 3½"×1½". The slot 180 is approximately 2" long from end to end, and is approximately 11/16" wide. The center of the slot 180 is substantially centered lengthwise, and is located approximately ⅝" from one of the long sides so as to be off centered widthwise. The coupling nut 182 is an approximately 2" long nut that is threaded to receive ⅝" bolts from both ends so as to provide mechanical coupling between the two bolts.

To interconnect the post 110 to the foundation 120, the bracket 100 (comprising the factory clinched inner and outer plates 200 and 300) is positioned so as to be interposed between the post 110 and the anchor bolt 130. The base section 214 is interposed between the post 110 and the foundation 120 to thereby protect the bottom of the post which allows for the use of non-pressure treated wood in some applications. The first section 202 of the inner plate 200 is in engagement lengthwise with the lower portion of the post 110, and the second section 204 is interposed between the bottom of the post 110 and the foundation 120. As such, the first direction specified above is downward.

The bracket 100 is attached to the post by a plurality of screws 150 that extend through the holes 320 of the outer plate 300 and the holes 250 of the inner plate 200 that are described above. In one embodiment, the screws 150 are ¼"×3" wood screws.

As shown in FIG. 1, the bracket 100 is interconnected to the foundation 120 by extending the hold down bolt 170 through the hole 174 on the washer plate 172, through the slot 180 on the bearing plate 176, through the slot 314 on the first offset section 304 (FIGS. 3A and 3C) of the outer plate 300, through the space defined by overlapping of the recesses 246 and 312, through the slot 316 of the second offset section 304*b* of the outer plate 300, so as to be received by one end of the coupling nut 182. The other end of the coupling nut 182 receives the threaded end of the anchor bolt 130 so as to be interconnected to the hold down bolt 170.

When a structure to which the post 110 is attached to experiences an uplifting force, the post experiences a tension force that can, if unmitigated, separate the post 110 from the foundation 120. The bracket 100 resists such an uplifting force by transferring the tension force from the post 110 to the foundation 120 via the connecting assembly 140. In particular, the hold down bolt 170 interconnects the bracket 100 to the anchor bolt 130 via the buckling resistant portion of the bracket 100 so as to transfer the tension forces effectively.

Figure 5:
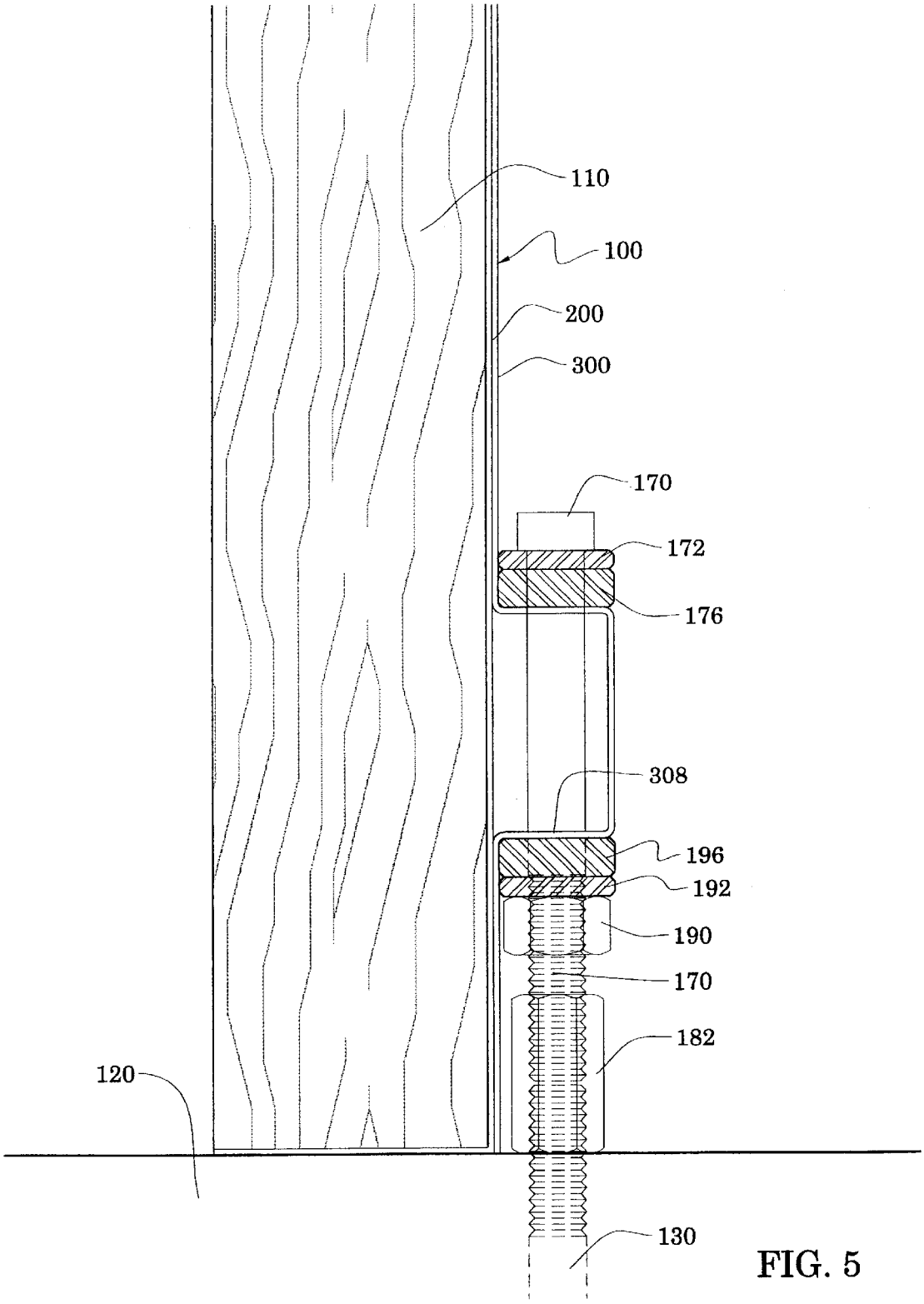
FIG. 5 illustrate an alternate embodiment of the bracket wherein an additional bearing plate enables the bracket to transfer portion of the downward compression force to the foundation.

FIG. 5 illustrates another embodiment of the invention wherein an additional bearing plate 196 and a washer plate 192 are positioned below the lower offset section 304*b* of the outer plate 300. In one embodiment, the bearing plate 196, interposed between the lower offset section 304*b* and the washer plate 192, is similar to the bearing plate 176 described above. The washer plate 192 is also similar to the washer plate 172 described above. The washer plate 192 and the bearing plate 196 are secured in place adjacent the lower offset section 304*b* by a nut 190 that is sized to receive the bolt 170. In one embodiment, the inner and outer plates 200, 300 may have their respective recesses 246, 312 located higher to accommodate the extra vertical space occupied by the additional bearing plate 196 and washer plate 192. Accordingly, the bolt 170 may be longer. The bolt 170 is interconnected to the anchor bolt 130 by the coupling nut 182.

The bearing plate 196 permits portion of a downward compression force on the post 110 to be transferred to the anchor bolt 130 via the hold down bolt 170. As such, the bracket 100 and the connecting assembly provides relief to the post 110 when the post 110 is subjected to a compressive force.

Figure 6:
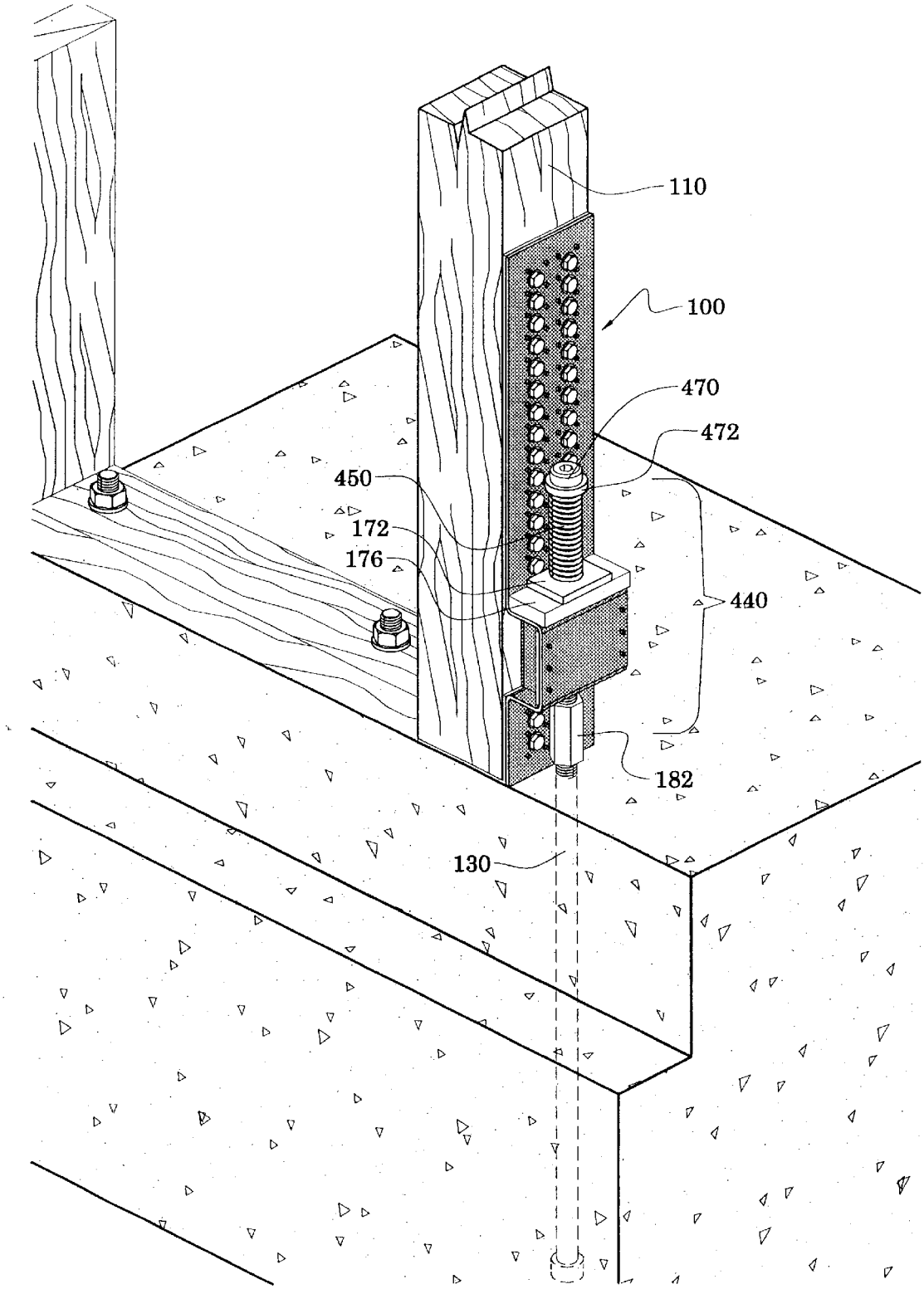
FIG. 6 illustrates another embodiment of the invention wherein a spring couples the bracket to the foundation so as to provide ductility when the post experiences an uplifting force.

Another embodiment of the invention is illustrated in FIG. 6, wherein a connecting assembly 440 comprises a spring 450 to provide a limited vertical movement when the post 110 experiences a tension force. The bracket 100 is substantially similar to that described above in reference to FIGS. 1 to 3, as are the washer plate 172 and the bearing plate 176 described above in reference to FIGS. 1 and 4.

In this embodiment, the spring is positioned above the washer plate 172, and is secured in place by a bolt 470 that extends through a washer 472, through the spring 450, through the washer plate 172 and the parts below it as described above in reference to FIG. 1, so as to be attached to the anchor bolt 182. Thus, one end of the spring 450 is attached to the bearing plate 176 (via the washer plate 172), and the other end of the spring 450 is attached to the foundation 120 via the hold down bolt 470 and the anchor bolt 130, so as to provide spring coupling between the foundation 120 and the bearing plate 176.

In an uplifting force situation, the spring 450, captured by the washer 472 and the washer plate 172, compresses as the bearing plate 176 moves upwards relative to the head of the bolt 470 (and thus the foundation). This ductility provided by the spring 470 dissipates at least a portion of the uplifting force. It will be appreciated that the connecting assembly 440 illustrated in FIG. 6 may also be adapted with additional bearing plate and washer plate as depicted in FIG. 5 to provide transferring of compression forces to the foundation in a manner described above In one embodiment, the bolt 470 is a ⅝"×8½" bolt. The washer 472 is a ¼" thick washer adapted to receive a ⅝" thread bolt. The spring 450 is wound from an ⅛" spring steel into a coil that is approximately 3" long and ¾" wide.

As will be understood, the bracket 100 can also be modified for use to interconnect vertical structures on separate floors. Two such brackets can be positioned adjacent each other with a bolt or fastener extending therebetween so thereby interconnect two vertical posts on adjacent floors.

Although the foregoing description of the embodiments of the invention has shown, described and pointed out the fundamental novel features of the invention, it will be understood that various omissions, substitutions and changes in the form of the detail of the apparatus as illustrated, as well as uses thereof, may be made by those skilled in the art without departing from the spirit of the invention. Consequently, the scope of the invention should not be limited to the foregoing discussion, but should be defined by the appended claims.

What is claimed is:

1. A device for transferring tension and compression forces incident on a vertical support of a building to an anchor bolt extending out of a foundation of the building, the device comprising:

an attachment member having at least one planar surface that is sized to be attached to the vertical support of building wherein the attachment member includes a laterally extending section that extends outward from the planar surface; and a load piece that is attached to the attachment member, wherein the load piece includes a mounting section that defines a recess that receives the laterally extending section such that the laterally extending section reinforces the mounting section and wherein the mounting section has an upper and lower surface that are substantially perpendicular to planar surface, wherein the upper and lower surfaces include openings through which the anchor bolt extends such that the anchor bolt can be coupled to the load piece with the laterally extending section of the attachment member reinforcing the mounting section of the load piece.

2. The device of claim 1, wherein the attachment member is attached to the load piece via clinching.

3. The device of claim 1, wherein the load piece includes at least one planar surface that is positioned adjacent the planar surface of the attachment member such that fasteners extend through both the load piece and the attachment member into the vertical of the building and so that the fasteners further couple the load piece and the attachment member together.

4. The device of claim 3, wherein the at least one planar surface of the attachment member and the load piece comprise a first and a second planar surfaces wherein the laterally extending section and the mounting section are interposed between the first and second planar surfaces of the attachment member and the load piece respectively.

5. The device of claim 1, wherein the laterally extending section of the attachment member comprise two laterally extending pieces that are integrally connected to the at least one planar member wherein flange sections are formed at the distal ends of the two laterally extending pieces and wherein the flanges are connected to recessed section of the load piece.

6. The device of claim 5, wherein the laterally extending pieces are sized so as to be flushly positioned within the recess defined by the recessed section to thereby reinforce the recessed section to inhibit deformation of the recessed section when under load.

7. The device of claim 1, wherein the attachment member includes a base plate that is attached to an end of the planar member so as to be positionable beneath the vertically extending member of the building structure.

8. The device of claim 1, further comprising a first reinforcing member that is positioned on the upper surface on the mounting section of the load piece, wherein the first reinforcing member includes an opening to receive the anchor bolt and wherein the anchor bolt and the first reinforcing member are mechanically coupled such that tension forces are exerted on the first reinforcing member to thereby inhibit the tension forces from deforming the mounting section.

9. The device of claim 8, further comprising a second reinforcing member that is positioned on the lower surface on the mounting section of the load piece, wherein the second reinforcing member includes an opening to receive the anchor bolt and wherein the anchor bolt and the second reinforcing member are mechanically coupled such that compressive forces are exerted on the second reinforcing member to thereby inhibit the compressive forces from deforming the mounting section.

10. The device of claim 9, wherein the openings in the upper and lower surfaces of the mounting section are adapted to permit attachment of the anchor bolt to the mounting section when the device is attached to the vertical support of the building over a range of positions.

11. The device of claim 9, further comprising a spring damper assembly mounted on the anchor bolt and engaging with the mounting section such that at least a portion of uplift forces are dissipated by the spring damper assembly.

12. A device for transferring tension and compression forces incident on a vertical support of a building to an anchor bolt extending out of a foundation of the building, the device comprising:

an attachment member having a planar surface that is attachable to the vertical support of the building wherein the attachment member is shaped so as to define a reinforcing section that extends outward from the planar surface;

a mounting member that is attached to the attachment member, wherein the mounting member includes a planar surface and is shaped so as to define a mounting section that defines a recess which receives the reinforcing section of the attachment member wherein the mounting member includes openings so as to permit the anchor bolt to extend therethrough such that when the anchor bolt is mechanically coupled to the mounting section and the planar surface of the attachment member is attached to the vertical support of the building, tension and compression forces incident on the vertical support of the building can be transmitted to the anchor bolt.

13. The device of claim 12, wherein the attachment member comprises an elongate sheet of metal having a first and a second end that is cut and bent to form the attachment member.

14. The device of claim 13, wherein reinforcing section includes two pieces of material extending perpendicularly from the planar surface that are formed by cutting two spaced slots inward from each of the lateral edges and then bending the two pieces.

15. The device of claim 14, wherein the reinforcing sections includes flanges that are formed by bending the outer edges of the two pieces and wherein the flanges are connected to the mounting member and wherein the reinforcing sections are sized so as to reinforce the mounting section.

16. The device of claim 13, wherein the mounting member comprises an elongate sheet of metal having a first and a second end that is bent to define the mounting section having a first and a second laterally extending surfaces that extend in a direction perpendicular to the planar surface and a recessed surface that extends in a direction parallel to the planar surface.

17. The device of claim 12, wherein the attachment member is attached to the mounting member via clinching.

18. The device of claim 17, wherein the at least one planar surface of the mounting member and the at least one planar surface of the attachment member are positioned adjacent to each other such that fasteners extend through both the planar surfaces into the vertical of the building and so that the fasteners further couple the mounting member and the attachment member together.

19. The device of claim 18, wherein the at least one planar surface of the attachment member and the mounting member comprise a first and a second planar surfaces wherein the reinforcing section and the mounting section are interposed between the first and second planar surfaces of the attachment member and the mounting member respectively.

20. The device of claim 19, wherein the attachment member includes a base plate that is attached to an end of the planar member so as to be positionable beneath the vertically extending member of the building structure.

21. The device of claim 12, further comprising a first reinforcing member that is positioned on the upper surface on the mounting section of the mounting member, wherein the first reinforcing member includes an opening to receive the anchor bolt and wherein the anchor bolt and the first reinforcing member are mechanically coupled such that tension forces are exerted on the first reinforcing member to thereby inhibit the tension forces from deforming the mounting section.

22. The device of claim 21, further comprising a second reinforcing member that is positioned on the lower surface on the mounting section of the mounting member, wherein the second reinforcing member includes an opening to receive the anchor bolt and wherein the anchor bolt and the second reinforcing member are mechanically coupled such that compressive forces are exerted on the second reinforcing member to thereby inhibit the compressive forces from deforming the mounting section.

23. The device of claim 22, wherein the openings in the upper and lower surfaces of the mounting section are adapted to permit attachment of the anchor bolt to the mounting section when the device is attached to the vertical support of the building over a range of positions.

24. The device of claim 23, further comprising a spring damper assembly mounted on the anchor bolt and engaging with the mounting section such that at least a portion of uplift forces are dissipated by the spring damper assembly.

25. A device for transferring tension and compression forces incident on a vertical support of a building to an anchor bolt extending out of a foundation of the building the device comprising:

an attachment section that defines a planar surface that is adapted to be attached to a side surface of the vertical support for the building;

a mounting section that extends laterally outward from the attachment section in a first direction, wherein the mounting section defines a mounting location such that the anchor bolt can be interconnected to the mounting section so that both tension and compressive forces incident on the vertical support of the building can be transferred to the anchor bolt; and a base section that extends outward from the attachment section in a second direction that is adapted to be at the interface between the vertical support of the building and the foundation to thereby protect the vertical support of the building.

26. The device of claim 25, wherein the attachment section comprises an attachment member and wherein the mounting section comprises a mounting member that is attached to the attachment section such that the attachment member reinforces the mounting member at the point of attachment between the anchor bolt and the mounting member.

27. The device of claim 26, wherein the attachment member comprises an elongate sheet of metal having a first and a second end that is cut and bent to form the attachment member.

28. The device of claim 27, wherein the mounting member comprises an elongate sheet of metal having a planar surface and a first and a second end that is bent to define the mounting section having a first and a second laterally extending surfaces that extend in a direction perpendicular to the planar surface and a recessed surface that extends in a direction parallel to the planar surface.

29. The device of claim 28, wherein the attachment member is attached to the mounting member via clinching.

30. The device of claim 29, wherein the at least one planar surface of the mounting member and the at least one planar surface of the attachment member are positioned adjacent to each other such that fasteners extend through both the planar surfaces into the vertical of the building and so that the fasteners further couple the mounting member and the attachment member together.

31. The device of claim 30, wherein the at least one planar surface of the attachment member and the mounting member comprise a first and a second planar surfaces wherein the reinforcing section and the mounting section are interposed between the first and second planar surfaces of the attachment member and the mounting member respectively.

32. The device of claim 26, further comprising a first reinforcing member that is positioned on an upper surface on the mounting section wherein the first reinforcing member includes an opening to receive the anchor bolt and wherein the anchor bolt and the first reinforcing member are mechanically coupled such that compressive forces are exerted on the first reinforcing member to thereby inhibit the uplift forces from deforming the mounting section.

33. The device of claim 32, further comprising a second reinforcing member that is positioned on a lower surface on the mounting section of the mounting member, wherein the second reinforcing member includes an opening to receive the anchor bolt and wherein the anchor bolt and the second reinforcing member are mechanically coupled such that uplift forces are exerted on the second reinforcing member to thereby inhibit the compressive forces from deforming the mounting section.

34. The device of claim 33, wherein the openings in the upper and lower surfaces of the mounting section are adapted to permit attachment of the anchor bolt to the mounting section when the device is attached to the vertical support of the building over a range of positions.

35. The device of claim 34, further comprising a spring damper assembly mounted on the anchor bolt and engaging with the mounting section such that at least a portion of uplift forces are dissipated by the spring damper assembly.

* * * * *